US007750823B2

(12) United States Patent
Kim et al.

(10) Patent No.: US 7,750,823 B2
(45) Date of Patent: Jul. 6, 2010

(54) APPARATUS AND METHOD FOR CHANNEL ALLOCATION ACCORDING TO TRAVELING DIRECTION IN INTER-VEHICLE COMMUNICATIONS

(75) Inventors: Jin Kyeong Kim, Daejeon (KR); Nae-Soo Kim, Daejeon (KR); Cheol Sig Pyo, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 328 days.

(21) Appl. No.: 11/776,161

(22) Filed: Jul. 11, 2007

(65) Prior Publication Data

US 2008/0136675 A1 Jun. 12, 2008

(30) Foreign Application Priority Data

Dec. 8, 2006 (KR) ..... 10-2006-0124287
Apr. 17, 2007 (KR) ..... 10-2007-0037444

(51) Int. Cl.
*G08G 1/08* (2006.01)

(52) U.S. Cl. ..... 340/902; 340/935; 340/539.1; 340/995.22; 455/509; 370/329; 701/200

(58) Field of Classification Search ..... 340/935, 340/933
See application file for complete search history.

(56) References Cited

U.S. PATENT DOCUMENTS 7,394,400 B2 * 7/2008 Tauchi ..... 340/901
2005/0222716 A1 * 10/2005 Tengler et al. ..... 701/1
2009/0010268 A1 * 1/2009 Giacomazzi et al. ..... 370/400

FOREIGN PATENT DOCUMENTS

JP 2006-254215 9/2006
JP 2006-293615 10/2006
KR 10-0521057 10/2005

* cited by examiner

*Primary Examiner*—Brian A Zimmerman
*Assistant Examiner*—Sara Samson
(74) *Attorney, Agent, or Firm*—Rabin & Berdo, P.C.

(57) ABSTRACT

An apparatus allocates a channel used for inter-vehicle communications according to a traveling direction. The apparatus includes a traveling direction determiner for determining whether or not a traveling direction of a vehicle is changed; and a channel allocator for allocating the vehicle a previously allocated channel or a new channel based on a determined result of the traveling direction determiner. Further, a method allocates a channel used for inter-vehicle communications according to a traveling direction. The method includes the steps of determining whether or not a traveling direction of a vehicle is changed; and allocating the vehicle a previously allocated channel or a new channel based on a determined result in the above step.

10 Claims, 5 Drawing Sheets

APPARATUS AND METHOD FOR CHANNEL ALLOCATION ACCORDING TO TRAVELING DIRECTION IN INTER-VEHICLE COMMUNICATIONS

FIELD OF THE INVENTION

The present invention relates to an apparatus and a method for channel allocation according to a traveling direction in inter-vehicle communications; and more particularly, to an apparatus and a method for channel allocation that facilitates a safe driving of a vehicle by receiving driving information only from vehicles preceding or following a user's vehicle on a same road while blocking driving information transmitted from vehicles traveling in an opposing side of the road.

BACKGROUND OF THE INVENTION

Inter-vehicle communications systems have been developed and are in use to enable communications between vehicles while traveling on roads. However, conventional inter-vehicle communications systems use the same channel regardless of each vehicle's traveling direction (i.e., regardless of whether the vehicles are on the same side or the opposing side of the road). Therefore, such systems have a drawback in that driving information about vehicles traveling on the opposing side, which is useless for driving, is received as well as driving information about vehicles traveling on the same side, which is useful for driving. Thus, there is a need for a technology that makes it possible for a moving vehicle to receive driving information about vehicles traveling on a road without receiving driving information about vehicles traveling on the opposing side of the road.

SUMMARY OF THE INVENTION

It is, therefore, an object of the present invention to provide an apparatus and a method for allocating channels according to respective vehicles' traveling directions, so that driving information can be received from vehicles traveling on a same road as that of a user's vehicle without receiving driving information transmitted from vehicles traveling in an opposing side of the road.

In accordance with an embodiment of the present invention, there is provided an apparatus for allocating a channel used for inter-vehicle communications, comprising a traveling direction determiner for determining whether or not a traveling direction of a vehicle is changed, and a channel allocator for allocating the vehicle a previously allocated channel or a new channel based on a determined result of the traveling direction determiner.

In accordance with another embodiment of the present invention, there is provided a method of allocating a channel used for inter-vehicle communications, comprising the steps of determining whether or not a traveling direction of a vehicle is changed; and allocating the vehicle a previously allocated channel or a new channel based on a determined result in the above step.

BRIEF DESCRIPTION OF THE DRAWINGS

The above and other objects and features of the present invention will become apparent from the following description of exemplary embodiments given in conjunction with the accompanying drawings, in which.

DETAILED DESCRIPTION OF THE EMBODIMENTS

Hereinafter, embodiments of the present invention will be described in detail with reference to the accompanying drawings so that they can be readily implemented by those skilled in the art.

Figure 1:
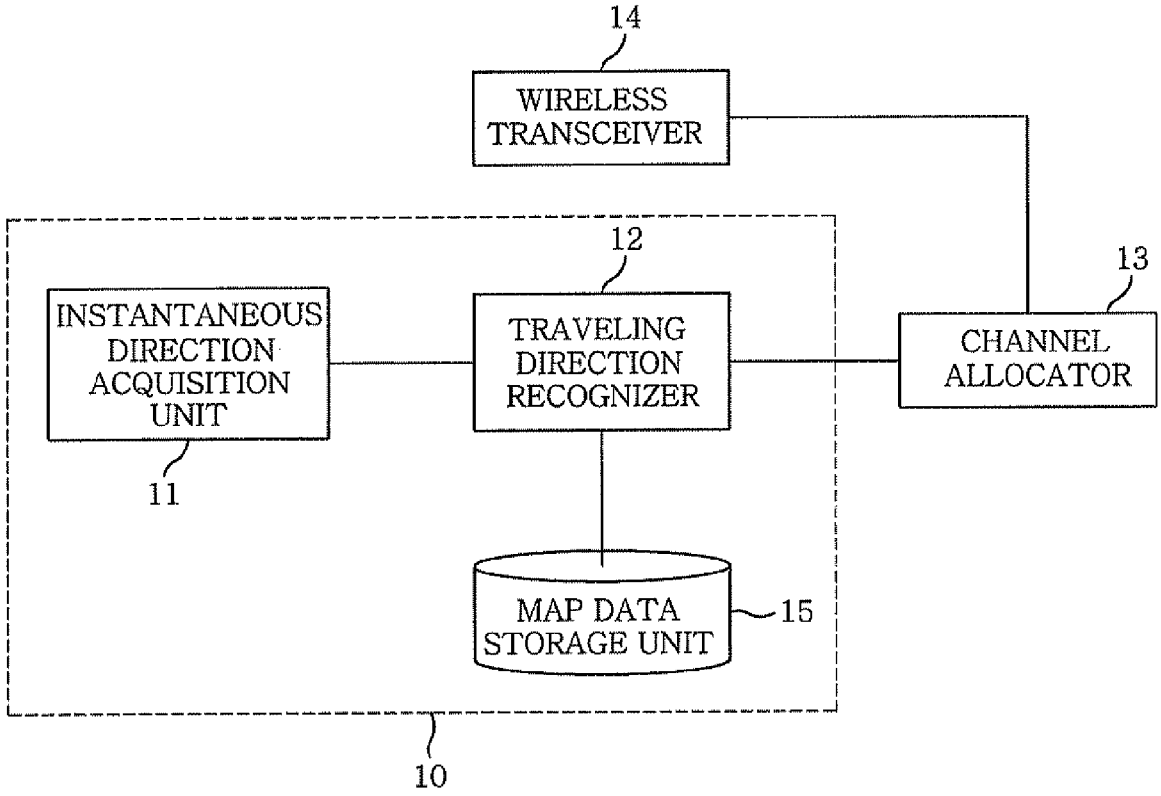
FIG. 1 is a block diagram for illustrating a channel allocation apparatus applicable to inter-vehicle communications system according to the present invention.

FIG. 1 is a block diagram illustrating a channel allocation apparatus applicable to inter-vehicle communications system according to the present invention.

As illustrated in FIG. 1, the apparatus for channel allocation includes an instantaneous direction acquisition unit 11, a traveling direction recognizer 12, a channel allocator 13, a wireless transceiver 14 and a map data storage unit 15. Hereinafter, the detailed description for each element will be given.

The instantaneous direction acquisition unit 11 includes, for example, an electronic compass or a global positioning system (GPS) receiver. The instantaneous direction acquisition unit 11 detects a vehicle's instantaneous direction in real time to thereby provide instantaneous direction information to the traveling direction recognizer 12.

The traveling direction recognizer 12 recognizes the vehicle's traveling direction based on the instantaneous direction information provided by the instantaneous direction acquisition unit 11, as well as map information (which includes, i.e., road information) stored in the map data storage unit 15. If it is determined from the map data that a road in which a vehicle is traveling is not changed, the traveling direction recognizer 12 determines that a vehicle's traveling direction is not changed even if the instantaneous direction information provided by the instantaneous direction acquisition unit 11 is changed.

The channel allocator 13 allocates channels to be used for sending and receiving driving information between the wireless transceiver 14 and other vehicles. In addition, if the traveling direction recognizer 12 determines that the vehicle's traveling direction is changed, the channel allocator 13 allocates a different channel to the wireless transceiver 14. Herein, the term "channel" means wireless resources including, e.g., time, frequency, code and so forth capable of acquiring orthogonality.

Through the channel allocated by the channel allocator 13, the wireless transceiver 14 exchanges the driving information with the vehicles preceding or following the user's vehicle on a same road.

In the illustrated example of FIG. 1, the instantaneous direction acquisition unit 11, the traveling direction recognizer 12 and the map data storage unit 15 are included in a traveling direction determiner 10 for determining the vehicle's traveling direction and whether or not the traveling direction is changed. However, this is merely an exemplary embodiment of the present invention. Alternatively, the instantaneous direction acquisition unit 11, the traveling direction recognizer 12 and the map data storage unit 15 may be configured by one or two blocks by combining two among the three units (i.e., the instantaneous direction acquisition unit 11, the traveling direction recognizer 12 and the map data storage unit 15).

Figure 2:
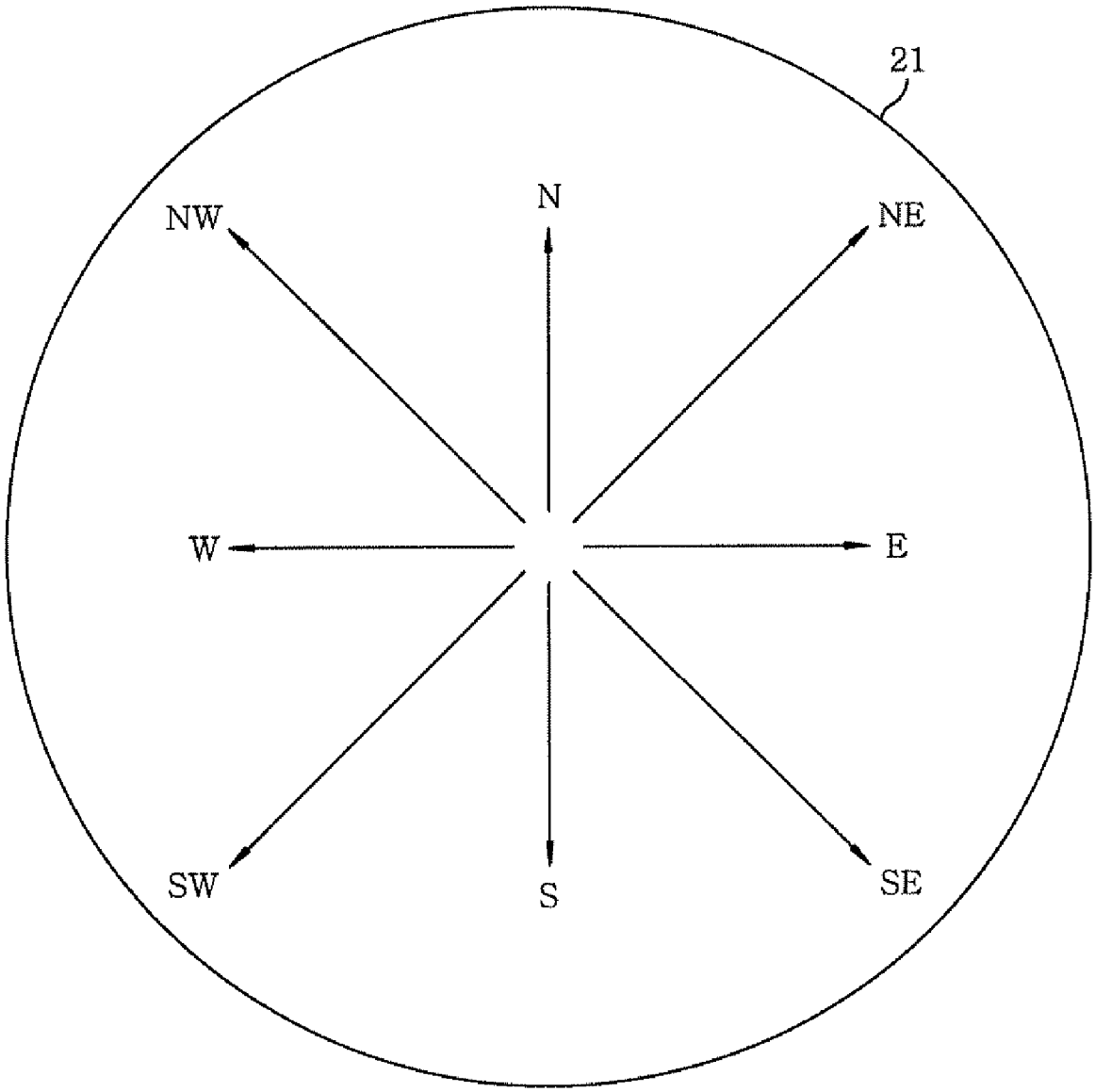
FIG. 2 is a conceptual diagram for describing eight-directional information used by an instantaneous direction acquisition unit of FIG. 1 for obtaining instantaneous direction information.

FIG. 2 is a conceptual diagram for showing eight-directional information that the instantaneous direction acquisition unit 11 uses for obtaining the instantaneous direction information.

As shown therein, in the present embodiment, directional information 21 is represented as the eight-directional information. The detailed description thereof will be provided in the following.

The eight-directional information designates one of N, S, E, W, NE, NW, SE and SW. Herein, "N" refers to North, "S" to South, "E" to East, "W" to West, "NE" to Northeast, "NW" to Northwest, "SE" to Southeast, and "SW" to Southwest. The instantaneous direction acquisition unit 11 converts the detected instantaneous direction of a vehicle into the instantaneous directional information in accordance with a geographical direction system (e.g., into the eight-directional information) to thereby provide the instantaneous directional information into the traveling direction recognizer 12.

Figure 3:
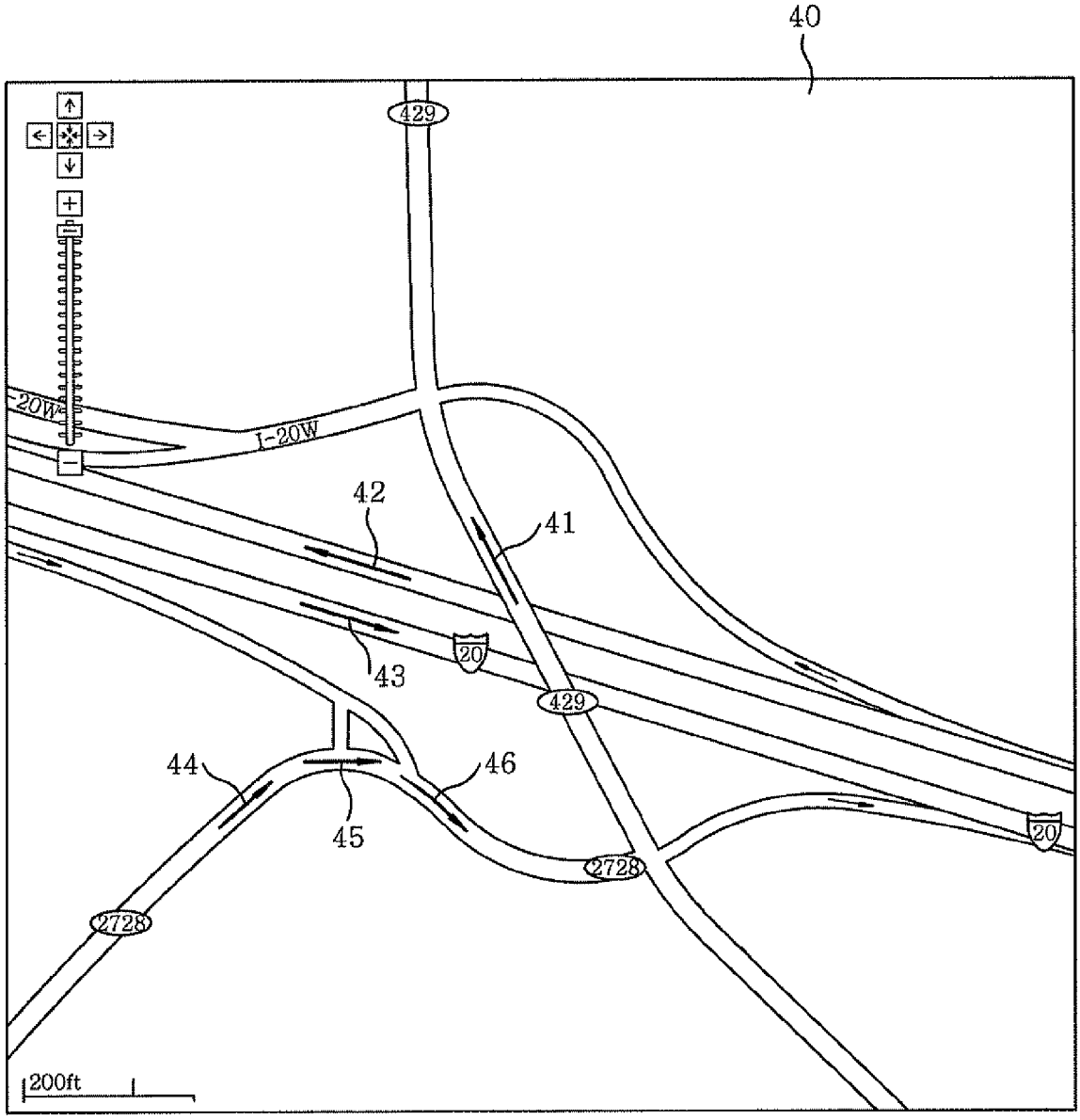
FIG. 3 is an example of map data for explaining the operation of a traveling direction recognizer of FIG. 1.

FIG. 3 is an example of map data used by the traveling direction recognizer 12. Hereinafter, there will be described the procedure of the traveling direction recognizer 12 recognizing the traveling direction.

Moving vehicles 41, 42 and 43 (indicated by arrows), which are traveling on the roads No. 20 and No. 429, illustrate some cases where the vehicle's traveling direction can be easily recognized only by using the instantaneous direction information acquired by the instantaneous direction acquisition unit 11 without referring to any map data. Since the roads No. 20 and No. 429 are close to straight lines, no major change in a vehicle's instantaneous direction occurs in the roads No. 20 and No. 429, which is surveyed by the instantaneous direction acquisition unit 11.

On the other hand, although moving vehicles 44, 45 and 46 are traveling on a same road (No. 2728) in a same direction, the instantaneous directions thereof are different from each other. More specifically, the instantaneous direction of the moving vehicle 44 is "NE" (Northeast), whereas those of the moving vehicles 45 and 46 are "E" (East) and "SE" (Southeast), respectively. In this case, if it is determine that the traveling directions of the vehicles 44 to 46 are changed based only on the instantaneous direction information, different channels are allocated to the vehicles 44 to 46. Thus, there occurs a problem in that, although traveling in a same road by preceding or following each other, the moving vehicles 44 to 46 cannot exchange driving information from each other.

To solve this problem, the traveling direction recognizer 12 in accordance with the present invention, by referring to the map data stored in the map data storage unit 15, determines that the vehicles traveling direction is not changed even when the instantaneous direction information is changed. Thus, although the instantaneous direction of each of the moving vehicles 44, 45 and 46 continuously changes, the traveling direction recognizer 12 detects that the vehicles 44, 45 and 46 are traveling on the road No. 2728 by referring to map data to thereby determine that the traveling direction of each of the vehicles is not changed. In this manner, it is possible to exchange driving information between moving vehicles preceding or following each other on a same road.

Figure 4:
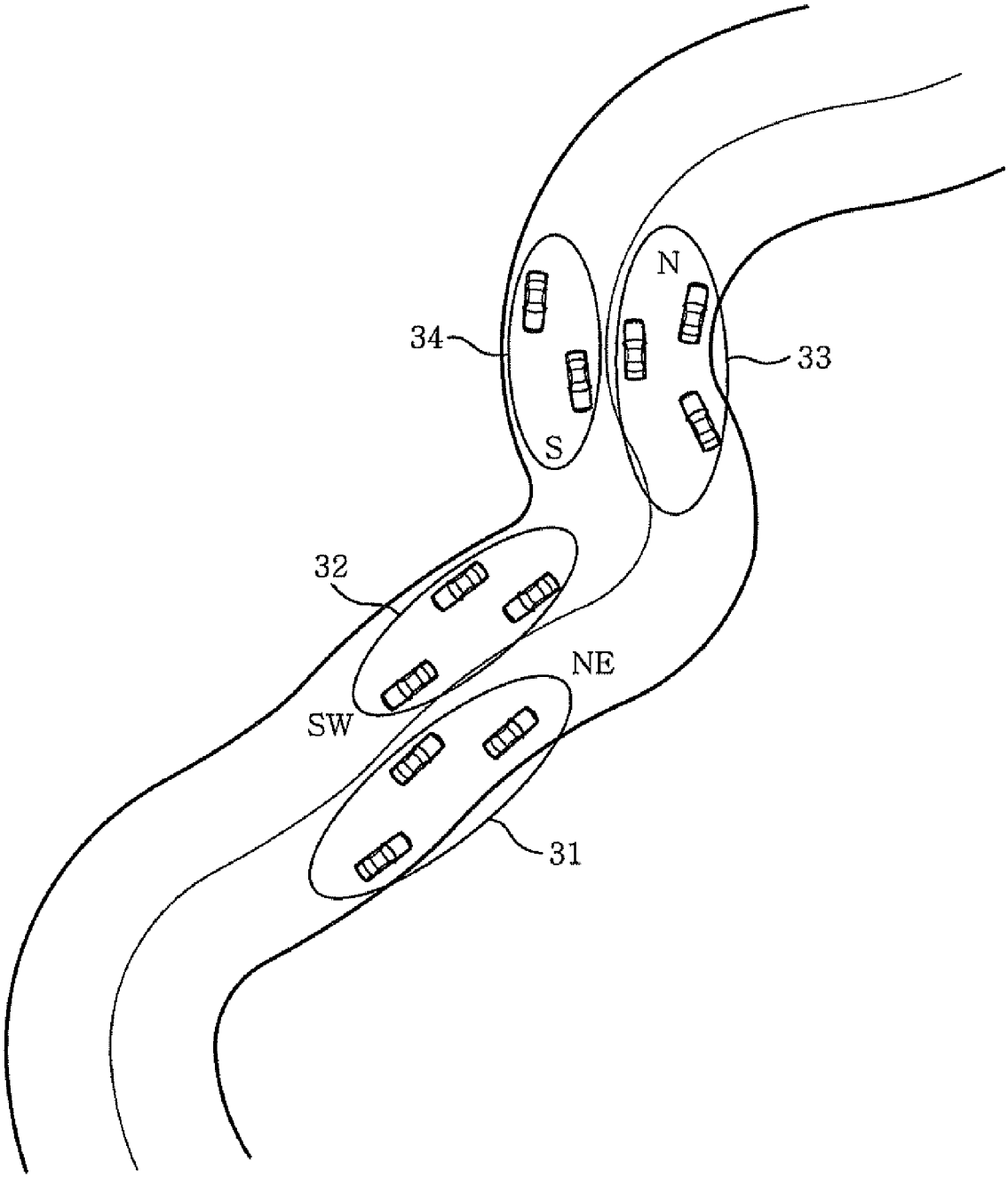
FIG. 4 is an example of a traffic state for explaining a channel allocation procedure of a channel allocator of FIG. 1.

FIG. 4 is an example of a traffic state for explaining a channel allocation procedure of the channel allocator 13 of FIG. 1.

As shown therein, an instantaneous direction of a group of vehicles 31 are determined to be "NE" based on the instantaneous direction information acquired by the instantaneous direction acquisition unit 11. In this case, if the traveling direction recognizer 12 determines that the traveling direction thereof is changed, the channel allocator 13 allocates a new channel. However, if it is determined from the map data that the traveling direction thereof is not changed, a previously allocated channel is maintained.

Further, an instantaneous direction of a group of vehicles 32 traveling in an opposing side of the road is determined to be "SW", based on the instantaneous direction information acquired by the instantaneous direction acquisition unit 11. In this case, if the traveling direction recognizer 12 determines by referring to the map data that the traveling direction thereof is different from that of the group of vehicles 31, the channel allocator 13 allocates them a channel different from that of the group of vehicles 31. More particularly, the group of vehicles 32 are allocated a different channel that does not cause any interference with that of the group of vehicles 31 (in other words, a channel capable of acquiring orthogonality). Thus, the group of vehicles 31 do not receive useless information transmitted from the group of vehicles 32 traveling in the opposing side of the road.

The channel allocation is performed in a same manner even when the group of vehicles 31 reach a position of a group of vehicles 33. In this case, if the traveling direction recognizer 12 determines that the traveling direction is changed based only on the instantaneous direction information acquired by the instantaneous direction acquisition unit 11, the group of vehicles 33 will be allocated a new channel. However, in accordance with the present invention, the traveling direction recognizer 12, by referring to the map data, recognizes that the vehicle's driving road and driving side of the road remain unchanged. Thus, the traveling direction recognizer 12 determines that the traveling direction of the group of vehicles 33 is not changed, so that the wireless transceiver 14 maintains the previously allocated channel.

Further, an instantaneous direction of a group of vehicles 34 traveling in the opposing side of the road is determined to be "S" based on the instantaneous direction information acquired by the instantaneous direction acquisition unit 11. The traveling direction recognizer 12 determines that the traveling direction thereof is changed by referring to the map data, so that the channel allocator 13 allocates a new channel corresponding to "S" to the group of vehicles 34. In this case, although the group of vehicles 33 continue to use the previously allocated channel corresponding to "NE", the orthogonality can be maintained because the group of vehicles 34 use a different channel corresponding to "S".

Figure 5:
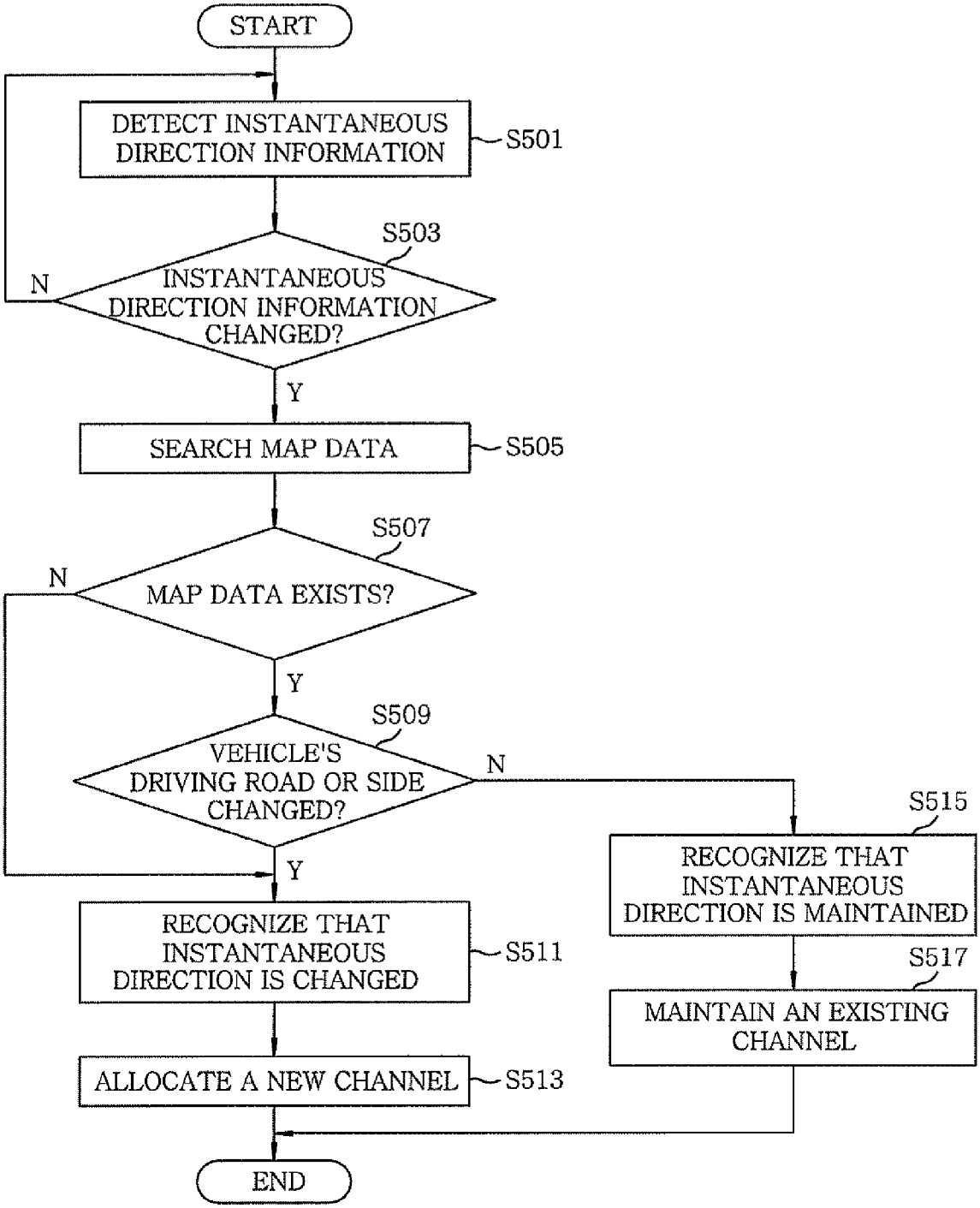
FIG. 5 is a flow chart illustrating a channel allocation method applicable to inter-vehicle communications system according to the present invention.

FIG. 5 is a flow chart illustrating a channel allocation method applicable to inter-vehicle communications system according to the present invention.

Firstly, the instantaneous direction acquisition unit 11 detects a vehicle's instantaneous direction in real time by using an electronic compass or a SPS receiver. Then, the instantaneous direction acquisition unit 11 converts the detected instantaneous direction into the instantaneous direction information in accordance with a geographical direction system (e.g., into the eight-directional information), and provides the instantaneous direction information to the traveling direction recognizer 12 (step S501).

Thereafter, the traveling direction recognizer 12 compares the instantaneous direction information transmitted from the instantaneous direction acquisition unit 11 to a previous one, and determines whether or not the instantaneous direction is changed (step S503).

If it is determined in step S503 that the instantaneous direction is changed based on the instantaneous direction information, the traveling direction recognizer 12 searches map data corresponding to a current driving position in the map data storage unit 15 (step S505). On the other hand, if it is determined in step S503 that the instantaneous direction is not changed based on the instantaneous direction information, the procedure returns to the step S501.

The traveling direction recognizer 12 determines, by referring to the map data searched in step S505, whether or not the moving vehicle changes its driving road or its driving side of the road (step S509). Herein, whether or not the moving vehicle changes its driving road or its driving side of the road is determined by comparing a current coordinate of the vehicle to a previous one on the map data. (Herein, as shown in FIG. 5, the procedure of step S507 may be performed prior to the step S509; a detailed description thereof will be given later.)

If it is determined in step S509 that the vehicle's driving road or driving side of the road is changed, the traveling direction recognizer 12 determines that the traveling direction of the vehicle is changed (step S511). On the other hand, if it is determined in step S509 that the vehicle's driving lane is not changed, the traveling direction recognizer 12 determines that the traveling direction is maintained (step S515). Then, information about the traveling direction and/or a change in the traveling direction is provided to the channel allocator 13.

If the traveling direction recognizer 12 notifies the channel allocator 13 that the traveling direction of the moving vehicle is maintained according to the determined result in step S515, the channel allocator 13 maintains an existing channel allocated to the wireless transceiver 14 (step S517).

However, if the traveling direction recognizer 12 notifies the channel allocator 13 that the traveling direction of the moving vehicle is changed according to the determined result of step S511, the channel allocator 13 allocates a new channel to the wireless transceiver 14 instead of the existing channel (step S513). In this manner, the orthogonality of the channel can be maintained by allocating the new channel in accordance with the changed traveling direction.

In response to a request of the traveling direction recognizer 12, the channel allocator 13 allocates a channel in accordance with the geographical direction system (e.g., as the eight-directional information), and notifies the wireless transceiver 14 of the allocated channel. Specifically, the channel allocator 13 allocates channels in the number equivalent to eight or smaller than eight, depending on the available number of channels, so that the channels are allocated in accordance with the geographical direction system (e.g., as the eight-directional information). Thus, the number of channels may be changed depending on channel conditions.

While the procedure of step S509 is performed after step S505 in the above description, it is also possible to perform the procedure of step S507 subsequent to step S505 and prior to step S509 as shown in FIG. 5.

More particularly, if map data corresponding to a current position of the vehicle is found in step S505, it is determined in step S507 that the map data exists, and the procedure proceeds to step S509. However, if map data corresponding to the current position of the vehicle is not found in step S505, it is determined in step S507 that the map data does not exist, and, without performing step S509, the procedure proceeds to step S511 so that the traveling direction is regarded to be changed, and then to step S513 to allocate a new channel.

The exemplary embodiments of the present invention described above can be implemented in a general-purpose digital computer that runs a program by using a computer-readable storage medium, or can be written as a program operable in a computer. The storage medium may be a is magnetic medium such as a read only memory (ROM), a floppy disk or hard disk; an optical media such as a CD-ROM or DVD; a carrier wave transmitted through an internet; or the like.

As can be understood from the foregoing, the present invention is to allocate channels according to vehicle's traveling direction such that driving information is received only from vehicles preceding or following a user's vehicle on a same road while blocking driving information transmitted from vehicles traveling in an opposing side of the road. Thus, a safe driving can be facilitated by providing a vehicle with efficient driving information.

While the invention has been shown and described with respect to the embodiments, it will be understood by those skilled in the art that various changes and modifications may be made without departing from the scope of the invention as defined in the following claims.

What is claimed is:

1. An apparatus for allocating an inter-vehicle communication channel to a vehicle, comprising:

a traveling direction determiner for determining whether or not a traveling direction of the vehicle is changed, including an instantaneous direction acquisition unit acquiring information as to the instantaneous traveling direction of the vehicle, a map data storage unit storing map data, and a traveling direction recognizer, determining whether the traveling direction of the vehicle is changed according to the instantaneous traveling direction information and the map data, wherein the traveling direction recognizer further determines, based on the map data, whether at least one of a road on which the vehicle is traveling and a side of the road on which the vehicle is traveling is changed; and, if the traveling direction recognizer determines that the at least one of the road traveled on and the side of the road has not changed, the traveling direction recognizer determines that the traveling direction of the vehicle is not changed, even when the instantaneous direction information is changed; and a channel allocator for allocating to the vehicle a previously allocated channel or a new channel based on a determined result of the traveling direction determiner, wherein if the traveling direction determiner determines that the traveling direction of the vehicle is changed, the channel allocator allocates to the vehicle a new channel corresponding to the changed traveling direction, the new channel being orthogonal to the previously allocated channel, and if the traveling direction determiner determines that the traveling direction of the vehicle has not changed, the channel allocator allocates to the vehicle the previously allocated channel.

2. The apparatus of claim 1, wherein the instantaneous direction acquisition unit detects the instantaneous traveling direction of the vehicle, and converts the detected instantaneous traveling direction in accordance with a geographical direction system to provide the converted instantaneous traveling direction as the instantaneous traveling direction information.

3. The apparatus of claim 2, wherein the instantaneous direction acquisition unit converts the instantaneous traveling direction into eight-directional information that designates one of North, South, East, West, Northeast, Northwest, Southeast and Southwest.

4. The apparatus of claim 1, wherein the new channel is a wireless channel.

5. The apparatus of claim 1, wherein the new channel is allocated to be orthogonal to the previously allocated channel using one of time division multiplexing, frequency division multiplexing and code division multiplexing.

6. A method of allocating an inter-vehicle communication channel to a vehicle, comprising:

(a) deciding whether or not a traveling direction of the vehicle is changed, including acquiring information as to the instantaneous traveling direction of the vehicle, finding map data corresponding to a current position of the vehicle, and determining whether or not the traveling direction of the vehicle is changed based on the instantaneous traveling direction information and the map data, and if said determining determines that the at least one of the driving road and the side of the road on which the vehicle is traveling has not changed, further determining that the traveling direction of the vehicle is not changed even when the instantaneous direction information is changed; and (b) a channel allocator allocating to the vehicle a previously allocated channel or a new channel based on a determined result in said step (a), wherein if the traveling direction of the vehicle is changed, the vehicle is allocated a new channel, the new channel being orthogonal to the previously allocated channel, and if the traveling direction of the vehicle has not changed, the channel allocator allocates to the vehicle the previously allocated channel.

7. The method of claim 6, wherein said acquiring includes:

detecting the instantaneous traveling direction of the vehicle;

converting the detected instantaneous traveling direction in accordance with a geographical direction system; and providing the converted instantaneous traveling direction as the instantaneous traveling direction information.

8. The method of claim 7, wherein, in said converting, the instantaneous traveling direction is converted into eight-directional information that designates one of North, South, East, West, Northeast, Northwest, Southeast and Southwest.

9. The method of claim 6, wherein the channel is a wireless channel resource capable of acquiring orthogonality.

10. The apparatus of claim 6, wherein the new channel is allocated to be orthogonal to the previously allocated channel using one of time division multiplexing, frequency division multiplexing and code division multiplexing.

* * * * *